US010443932B2

(12) United States Patent
Whitney et al.

(10) Patent No.: US 10,443,932 B2
(45) Date of Patent: Oct. 15, 2019

(54) REFRIGERANT VENT RECTIFIER AND EFFICIENCY BOOSTER

(71) Applicants: Mark Whitney, Houston, TX (US); Mark Ulrich, Houston, TX (US)

(72) Inventors: Mark Whitney, Houston, TX (US); Mark Ulrich, Houston, TX (US)

(73) Assignee: Linde Aktiengesellschaft (DE)

( * ) Notice: Subject to any disclaimer, the term of this patent is extended or adjusted under 35 U.S.C. 154(b) by 545 days.

(21) Appl. No.: 15/168,314

(22) Filed: May 31, 2016

(65) Prior Publication Data

US 2017/0343280 A1 Nov. 30, 2017

(51) Int. Cl.

| | |
|---|---|
| ***F25J 3/08*** | (2006.01) |
| ***F25J 3/02*** | (2006.01) |
| ***F25B 1/10*** | (2006.01) |
| ***F25B 5/04*** | (2006.01) |
| ***F25B 9/00*** | (2006.01) |
| ***F25B 43/04*** | (2006.01) |
| ***F25J 1/00*** | (2006.01) |
| ***F25J 1/02*** | (2006.01) |

(52) U.S. Cl.

CPC ..... *F25J 3/08* (2013.01); *F25B 1/10* (2013.01); *F25B 5/04* (2013.01); *F25B 9/002* (2013.01); *F25B 43/043* (2013.01); *F25J 1/0052* (2013.01); *F25J 1/0085* (2013.01); *F25J 1/025* (2013.01); *F25J 1/0268* (2013.01); *F25J 1/0274* (2013.01); *F25J 3/0219* (2013.01); *F25J 3/0238* (2013.01); *F25J 3/0252* (2013.01); *F25B 2400/13* (2013.01); *F25B 2400/23* (2013.01); *F25J 2210/12* (2013.01); *F25J 2210/42* (2013.01); *F25J 2215/62* (2013.01); *F25J 2270/12* (2013.01); *F25J 2270/42* (2013.01); *F25J 2270/60* (2013.01); *F25J 2270/902* (2013.01); *F25J 2270/904* (2013.01); *F25J 2290/80* (2013.01)

(58) Field of Classification Search

CPC ..... F25B 43/04; F25B 43/043; F25J 1/0022; F25J 1/0085

See application file for complete search history.

(56) References Cited

U.S. PATENT DOCUMENTS

| | | | | |
|---|---|---|---|---|
| 4,674,290 | A * | 6/1987 | Verser | F17C 13/025 62/49.1 |
| 2011/0277498 | A1* | 11/2011 | Kaart | F04D 27/0207 62/613 |
| 2016/0061518 | A1* | 3/2016 | Seitter | F25J 1/0022 62/613 |
| 2016/0282042 | A1* | 9/2016 | Nikiforuk | F25B 15/04 |

* cited by examiner

*Primary Examiner* — Brian M King
(74) *Attorney, Agent, or Firm* — Ralph J. Mancini

(57) ABSTRACT

A refrigeration system for use in petrochemical plants, such as an ethylene production plant includes a refrigerant vent rectifier. The rectifier purifies the refrigerant by removing low molecular weight inerts. The refrigeration system is more efficient, consumes less energy and increases plant capacity.

4 Claims, 3 Drawing Sheets

REFRIGERANT VENT RECTIFIER AND EFFICIENCY BOOSTER

BACKGROUND OF THE INVENTION

The invention relates to the use of liquid nitrogen to enhance the operation of a closed loop refrigeration system for industrial plants.

Many industrial processes require refrigeration systems. For example, the recovery of olefins from gas mixtures is an economically important but highly energy intensive petrochemical process. In general, the gas mixtures are produced by hydrocarbon pyrolysis in the presence of steam (via thermal cracking, fluid catalytic cracking or fluid coking processes). Thereafter, Cryogenic separation methods are commonly used to recover the olefins, such methods requiring large amounts of refrigeration at low temperatures.

A more specific example is an ethylene production plant. Refrigeration is required to separate desired products from the cracking heater effluent. The refrigeration may be provided by water cooling, closed cycle propylene and ethylene systems, or work expansion of pressurized light gases from the separation process.

Also, in plants of this type, gaseous nitrogen is required for numerous uses within the plant. It is typical for the nitrogen to be delivered to the plant as a cryogenic liquid. The liquid nitrogen must be vaporized and heated in order to provide nitrogen gas at usable temperatures and pressures. Typically, this is done using air at ambient condition to vaporize and heat the nitrogen. Nitrogen vaporizes below −14° C. The vaporizing and heating can be energy use intensive. For example, to heat nitrogen to 35° C. ambient conditions requires about 83 calories per gram of nitrogen. A plant needing 100 kilowatts of refrigeration will generally need 1,000 kg/hr of nitrogen. Therefore the energy required for heating the nitrogen is in the range of 83 million calories per hour, e.g. a considerable amount.

FIG. 1 shows a refrigeration system as known in the prior art. In the system shown in FIG. 1, the $2^{nd}$ Stage Refrigerant Compressor discharge is condensed in the Refrigerant Condenser before entering the Refrigerant Accumulator. Refrigerant liquid is flashed to a lower pressure and then partially vaporized in the $2^{nd}$ Stage Refrigerant User. The refrigerant than enters the $2^{nd}$ Stage Suction Drum where liquid is removed and then sent to the $1^{st}$ Stage Refrigerant User, where the refrigerant is flashed to a lower pressure and completely vaporized. The vapor form the $2^{nd}$ Stage Suction Drum is returned to the $2^{nd}$ Stage Refrigerant Compressor. The vapor from the $1^{st}$ Stage Refrigerant User is processed in the $1^{st}$ Stage Suction Drum to remove any entrained liquids and then sent on to the $1^{st}$ Stage Refrigerant Compressor.

For use in an ethylene plant, a typical closed loop refrigeration system is shown in FIG. 1. Inherent limitations of the refrigeration system often limit the production capacity of the plant, which in the industry is referred to as a "bottleneck". To relieve this bottleneck, the addition of refrigeration capacity may be necessary, in which case, expensive modifications or replacement of compressors, heat exchangers, drums and the like may be required. Even if the refrigeration system is not a plant bottleneck, addition of cooling duty to the refrigeration system and removal of inerts via recovery of refrigerant significantly reduces refrigerant compressor power demand and therefore significantly reduce energy consumption and associated operating expenses.

There remains a need in the art for improvements to refrigeration systems for use in industrial plants, such as petrochemical plants.

BRIEF DESCRIPTION OF THE DRAWINGS

For a more complete understanding of the invention, reference may be had to the following description of exemplary embodiments considered in connection with the accompanying drawing Figures, of which.

DETAILED DESCRIPTION OF THE INVENTION

Before explaining the inventive embodiments in detail, it is to be understood that the invention is not limited in its application to the details of construction and arrangement of parts illustrated in the accompanying drawings. Rather, the invention is capable of other embodiments and being practiced or carried out in various ways. Also, it is to be understood that the phraseology or terminology employed herein is for the purpose of description and not of limitation. The drawings are for the purpose of illustrating the invention and are not intended to be to scale.

The refrigeration system according to the invention, as will be more fully described below, it is advantageous in that it provides means to recover refrigeration for reuse in the refrigeration system or elsewhere in the plant. The additional refrigeration can alleviate problems associated with bottleneck situations arising from the need or higher refrigeration capacity. This in turn can reduce or eliminate the need for additions or modifications to the plant machinery, thus reducing capital expenditure. The recovered refrigeration may be used to reduce the refrigeration compressor power demand, thereby reducing energy consumption and lowering associated operating costs.

In addition, the refrigeration system of the invention has the benefit of being able to remove low molecular weight impurities that would otherwise build up within the refrigerant. These impurities often enter the closed loop refrigerant system through leaks, poor quality component materials, insufficient purging and poorly vented seals. The impurities, referred to as "inerts", have a boiling point much lower than the normal refrigerant being used and can cause a number of adverse effects.

For example, the inerts can increase refrigerant discharge pressure thereby raising compressor power consumption. The inerts may also reduce the capacity of the refrigeration system by displacing the heavier, normal refrigerant. Further, the inerts can create a bubble of non-condensable vapor at the top of the refrigerant condenser that forms a "blanket" that prevents incoming refrigerant vapor from contacting the cold surface of the condenser and therefore reducing refrigeration efficiency. The presence of inerts also lowers the refrigerant flash temperatures and reduces the safety margin between the refrigerant and the minimum design metal temperature of the refrigeration system inerts also cause losses of valuable refrigerant to flare when the refrigeration system must be vented to remove excess inerts.

By using the refrigeration system of the invention, inerts can be easily removed from the refrigerant via distillation achieved by chilling the refrigerant using heat exchange with vaporized liquid nitrogen. The nitrogen can reach temperatures below those for a typical refrigeration system, and the vaporized nitrogen can be used within the olefin plant for typical uses.

Figure 1:
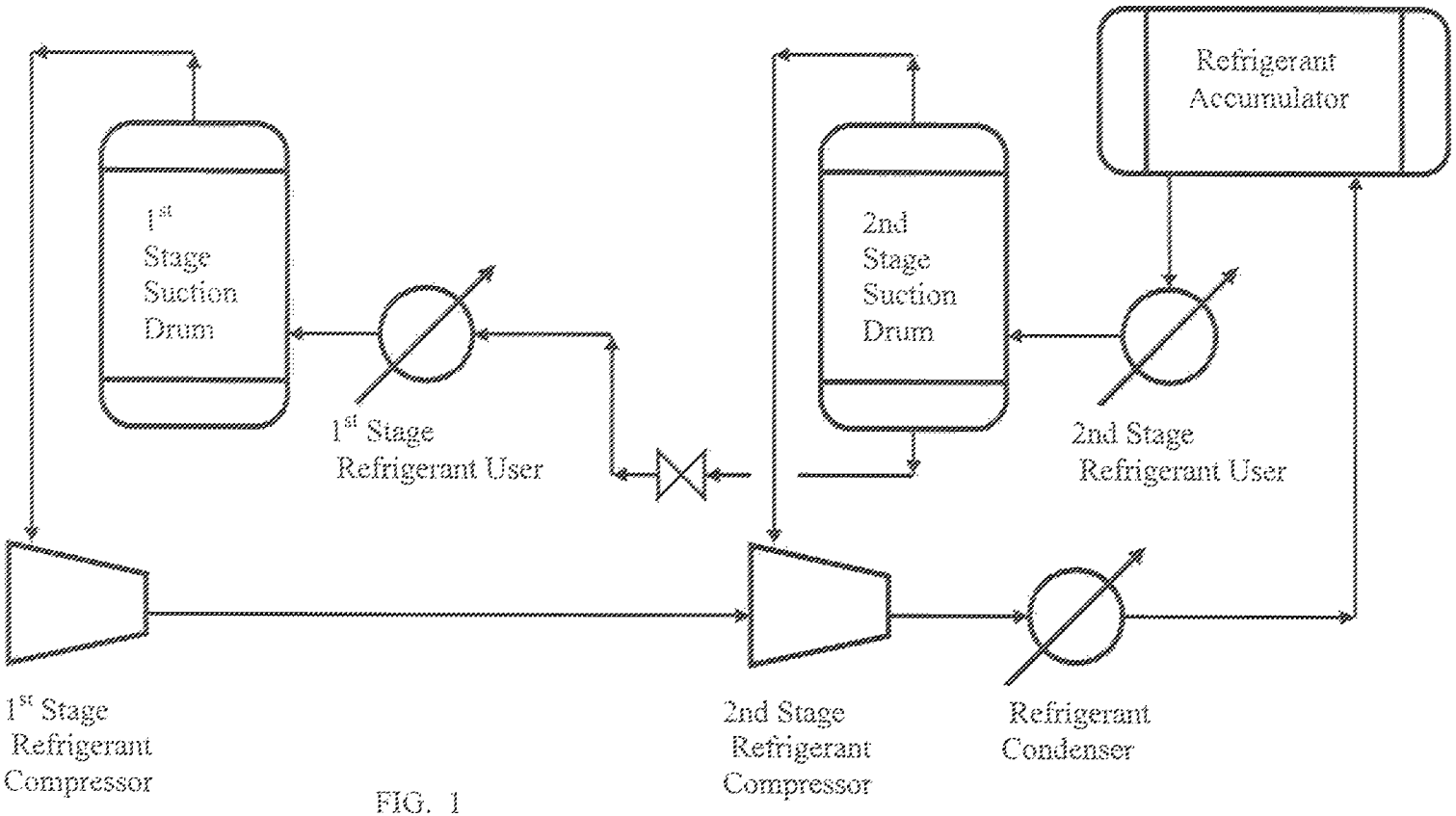
FIG. 1 Prior Art
FIG. 1 is a prior art schematic diagram showing a refrigeration system as known in the art.
Figure 2:
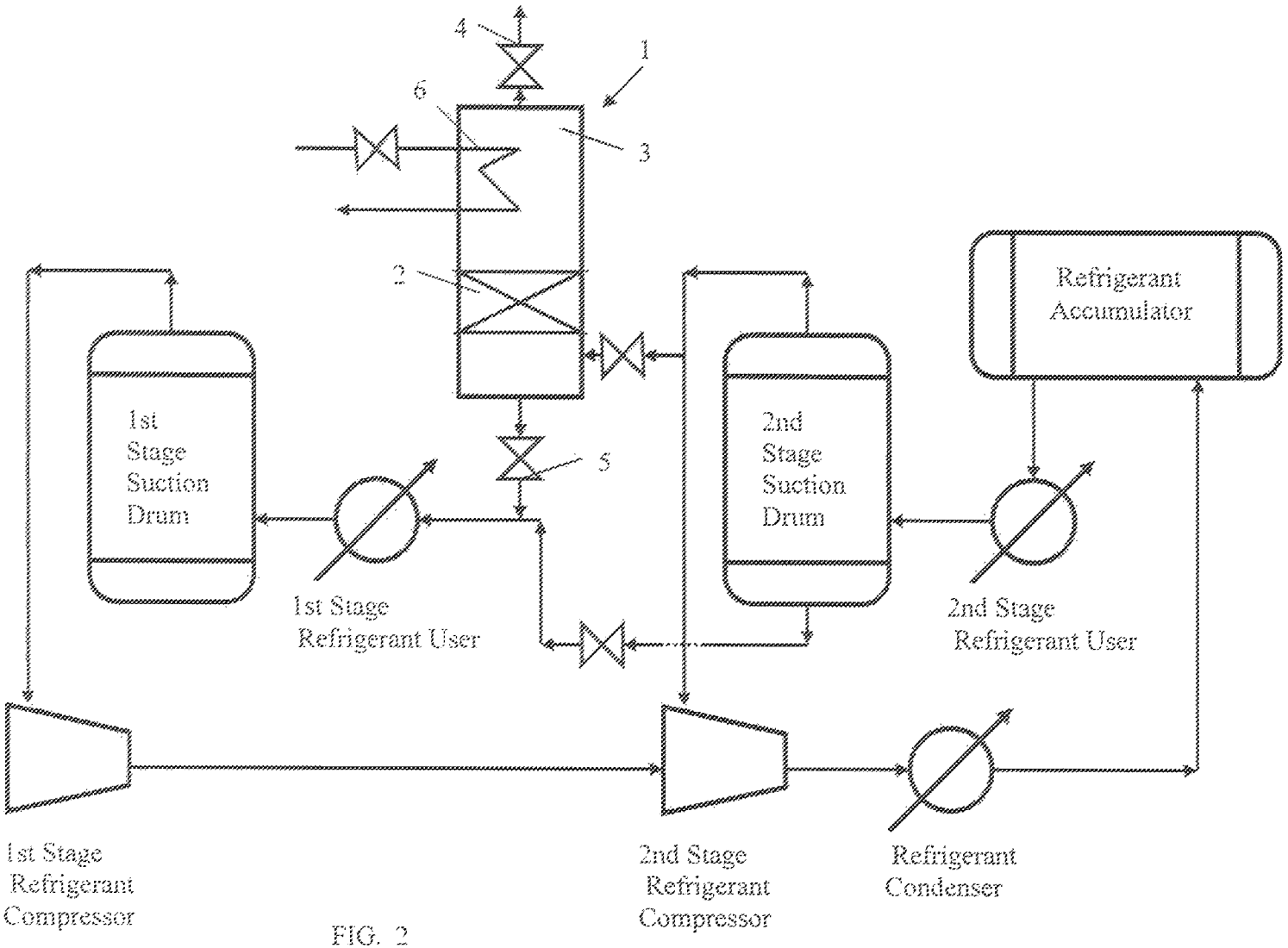
FIG. 2 is a schematic diagram showing a refrigeration system according to a first embodiment of the invention.

A first embodiment of the invention nail be described with reference to FIG. 2. FIG. 2, includes all of the components described in FIG. 1 above for a refrigeration system. In particular, the refrigeration system of the invention includes $1^{st}$ and $2^{nd}$ Stage Refrigerant Compressors, $1^{st}$ and $2^{nd}$ Stage Suction Drums, a Refrigerant Condenser, and a Refrigerant Accumulator, that operate as described above to provide refrigerant to $1^{st}$ and $2^{nd}$ Stage Refrigerant Users.

For purposes of explaining the operation of the refrigeration system of the invention, the discussion that follows, refers to use in an ethylene production plant. The refrigeration system according to the invention includes a Refrigerant Vent Rectifier 1, as shown in FIG. 2. The rectifier 1 has a generally cylindrical cross section and is used to process some of the vapor from the $2^{nd}$ Stage Suction Drum which is diverted to the rectifier 1. The diverted vapor is fed into a lower section of the rectifier 1, and passes up through a packed section 2. In the packed section 2, the vapor directly encounters liquid coming down through the packed section 2. This liquid is produced by condensation on a heat exchanger 6, in the top section 3, of the rectifier 1, wherein nitrogen is heated and vaporized. The liquid washes ethylene out of the vapor while at the same time the vapor strips inerts (such as methane) from the liquid. The vapor that reaches the top of the rectifier is then vented to flare 4. This vapor contains very little ethylene, which instead has been washed out of the vapor and exits the rectifier 1, from the bottom through a valve 5. This ethylene is virtually free of inerts.

Figure 3:
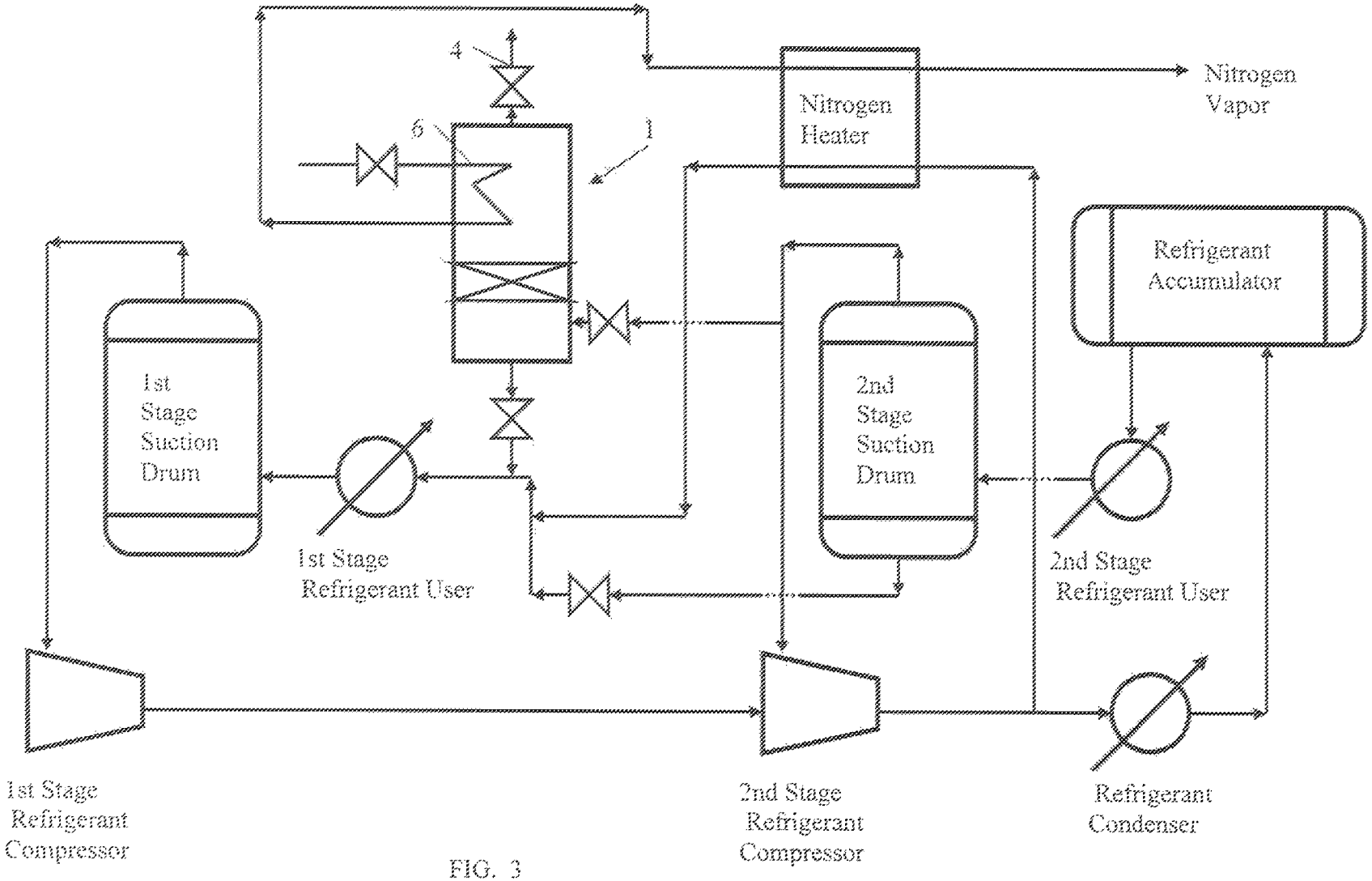
FIG. 3 is a schematic diagram showing a refrigeration system according to a second embodiment of the invention.

As shown in FIG. 2, nitrogen used in the rectifier exits from the heat exchanger 6. This nitrogen is not warm enough for use in the plant and so would need to be warmed before use. Therefore according to a second embodiment of the invention as shown in FIG. 3, the nitrogen is further processed to raise the temperature thereof. The nitrogen leaving the heat exchanger 6, is heated against the refrigeration process in order to save additional power. A portion of the vapor from the $2^{nd}$ Stage Refrigerant Compressor is desuperheated and condensed against the nitrogen from the heal exchanger 6, in a Nitrogen Heater. The refrigerant from the $2^{nd}$ Stage Refrigerant Compressor is hot enough to warm the nitrogen sufficiently so that nitrogen leaving the nitrogen heater can be used elsewhere in the plant. The refrigerant exiting the Nitrogen Heater is returned to the process between the $2^{nd}$ Stage Suction Drum and the $1^{st}$ Stage Refrigerant User.

In some cases, the refrigerant does not require removal of inerts. In that event, the rectifier vent 4, (see FIG. 3) can be closed and an of the condensed refrigerant can be returned to the $1^{st}$ Stage Refrigeration User.

The refrigerant system of the invention provides a number of advantages. The system of the invention enables removal of inerts from the closed loop refrigeration system. This has the effect of reducing refrigeration compressor discharge pressure which results in saving of compression power. Further, the circulating refrigerant does not contain the light impurities which means that vaporizing refrigerant is able to absorb more energy per kilogram and per liter, thereby increasing the capacity of the refrigeration system. In addition, there are no pockets of inert vapor that would otherwise fill the upper sections of equipment like the condenser. Therefore, application of the invention allows the system to operate and function more efficiently. The flash temperature of the refrigerant after a pressure reduction will be warmer without the presence of inerts, which allows the design margin between refrigerant temperature and the minimum design metal temperature to be maintained.

By using the Refrigerant Vent Rectifier according to the invention, the vapor being vented is purified and reduces the loss of valuable refrigerant while inerts are being removed. The inert vent condenser also serves to condense low pressure refrigerant and to supply liquid refrigerant to the coldest users. This enhances the operation of the refrigeration system.

Even when inerts do not need to removed from the system, by using the Refrigerant Vent Rectifier of the invention, overall plant efficiency can be improved.

The above description refers to use of the invention in an ethylene production plant. For such an ethylene plant the invention can be used to purify refrigerant in any closed methane, ethylene or propylene refrigeration system. However, the invention is not so limited. The invention can also be used to purify the refrigerant in any closed loop refrigeration system (e.g. methane, ethylene, propylene). The system of the invention can be used for mixed refrigeration systems for use in ethylene or other production plants. Typical mixed refrigeration systems will contain methane and it is desirable to remove as much of the non-condensable hydrogen and nitrogen inerts from the system as possible. Make up methane for such a system typically contains hydrogen and nitrogen impurities. The system of the invention purges hydrogen and nitrogen from the system without excessive methane loss.

The system of the invention can also be used in other closed loop refrigeration systems, such as those used for natural gas liquefaction plants, air conditioning units and cold storage units. Once again removing inerts (such as nitrogen) from such a closed loop system provides the numerous advantages noted above.

It will be understood that the embodiments described herein are merely exemplary, and that a person skilled in the art may make variations and modifications without departing from the spirit and scope of the invention. All such variations and modifications are intended to be included within the scope of the invention defined by the claims. It should be understood that the embodiments described above are not only in the alternative, but can be combined.

What is claimed is:

1. A method of providing refrigerant to an industrial plant, the method comprising:

establishing a refrigerant system having a first stage refrigerant user, a second stage refrigerant user, a first stage suction drum, a second stage suction drum, a first stage refrigeration compressor, a second stage refrigeration compressor, a refrigerant condenser, a refrigerant accumulator and a refrigerant vent rectifier;

diverting a portion of refrigerant vapor exiting the second stage suction drum to a lower section of the vent rectifier;

producing liquid by condensation on a heat exchanger housed in a top section of the vent rectifier;

passing the diverted refrigerant vapor upward through a packed section of the vent rectifier;

passing the liquid down through the packed section of the vent rectifier;

washing ethylene out of the diverted refrigerant vapor in the packed section by contacting the diverted refrigerant vapor with the liquid;

stripping inert materials out of the liquid in the packed section by contacting the liquid with the diverted refrigerant vapor;

venting any diverted refrigerant vapor that reached the top section of the vent rectifier; and feeding nitrogen from the heat exchanger of the vent rectifier to a nitrogen heater wherein the nitrogen is heated using a portion of refrigerant vapor from the second stage refrigeration compressor.

2. The method according to claim 1, wherein the refrigeration system is a closed loop refrigeration system.

3. The method according to claim 1, wherein the first stage refrigerant user is a heat exchanger of the industrial plant and the second stage refrigerant user is a heat exchanger of the industrial plant.

4. The method according to claim 1, wherein the industrial plant is an ethylene production plant.

* * * * *